US008540330B2

(12) United States Patent
Ramakrishnan et al.

(10) Patent No.: US 8,540,330 B2
(45) Date of Patent: Sep. 24, 2013

(54) SYSTEM AND METHOD TO COMPENSATE FOR AN INOPERATIVE INKJET IN AN INKJET PRINTER

(75) Inventors: Bhaskar T. Ramakrishnan, Wilsonville, OR (US); Brent E. Fleming, Aloha, OR (US); Joel Chan, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 230 days.

(21) Appl. No.: 12/891,217

(22) Filed: Sep. 27, 2010

(65) Prior Publication Data

US 2012/0075370 A1 Mar. 29, 2012

(51) Int. Cl.
*B41J 29/38* (2006.01)

(52) U.S. Cl.
USPC ..... 347/10

(58) Field of Classification Search
None
See application file for complete search history.

(56) References Cited

U.S. PATENT DOCUMENTS

| | | | | |
|---|---|---|---|---|
| 5,581,284 | A | 12/1996 | Hermanson | |
| 5,764,252 | A * | 6/1998 | Burr et al. | 347/20 |
| 2007/0070111 | A1 * | 3/2007 | Vladislav | 347/19 |

* cited by examiner

*Primary Examiner* — Geoffrey Mruk
(74) *Attorney, Agent, or Firm* — Maginot, Moore & Beck, LLP

(57) ABSTRACT

An inkjet printer has been developed, which identifies one or more printing metrics and selects a corrective operation for image data. After application of the corrective operation to image data, firing signals are generated with reference to the modified image data to compensate for an inoperative inkjet in a printhead of the inkjet printer.

9 Claims, 4 Drawing Sheets

SYSTEM AND METHOD TO COMPENSATE FOR AN INOPERATIVE INKJET IN AN INKJET PRINTER

TECHNICAL FIELD

The present disclosure relates generally to inkjet imaging devices and, more particularly, to inkjet imaging devices that compensate for one or more inoperative inkjets.

BACKGROUND

Drop on demand inkjet technology for producing printed media has been employed in commercial products such as printers, plotters, facsimile machines, and other types of imaging apparatus. Generally, an inkjet image is formed by selectively ejecting ink drops onto an image substrate from a plurality of drop generators or inkjets, which are arranged in a printhead or a printhead assembly. For example, the image substrate is moved relative to the printhead assembly and the inkjets are controlled to eject ink drops at appropriate times. The timing of the inkjet activation is performed by a printhead controller, which generates firing signals. The inkjets eject ink in response to receiving the firing signals. The image substrate may be an intermediate image member, such as a print drum or belt, from which the ink image is later transferred to a print medium, such as paper. The image substrate may also be a moving web of print medium or sheets of a print medium onto which the ink drops are directly ejected. The composition of the ink ejected from the inkjets may be liquid ink, such as aqueous, solvent, oil based, UV curable ink or other ink compositions, which are stored in containers installed in the printer. Alternatively, the ink may be loaded in a solid form and delivered to a melting device, which heats the solid ink to its melting temperature to generate liquid ink, which is supplied to a printhead.

During the operational life of an inkjet printer, inkjets in one or more of the printheads may become unable to eject ink in response to receiving a firing signal. The inoperative condition of the inkjet may temporarily persist such that the inkjet becomes operational after one or more image printing cycles. In other cases, the inkjet may remain unable to eject ink until a maintenance cycle is performed. Execution of a maintenance cycle, however, requires the printer to be taken out of its image generating mode. Thus, maintenance cycles affect the throughput rate of a printer and are preferably performed during printer downtime.

Numerous types of compensation methods have been developed that enable a printer to print images of an acceptable image quality even though one or more inkjets of a printhead are unable to eject ink. In one compensation method, which is sometimes referred to as a corrective operation, an image rendering process is used to help control the generation of firing signals for operable inkjets. The rendering process modifies input image data, which is sometimes referred to as raw image data, to generate output image data. The output image data are used by the printhead controller to generate firing signals. The compensation method uses information identifying the inoperative inkjets to transition the output image data that corresponds to inoperative inkjets to output image data that corresponds to operable inkjet(s). For example, one compensation method may increase the amount of ink to be ejected by nearby operable inkjets to replace the amount of ink that should be ejected by the inoperative inkjet. The printhead controller generates firing signals for the inkjets with reference to the adjusted output image data so the operable nearby inkjets eject an amount of ink in the neighborhood of the inoperative inkjet to help mask the absence of ink not ejected by the inoperable inkjet. Various image types, ink colors, or other printing parameters affect the effectiveness of a compensation method to mask the effects of inoperative inkjets. Consequently, a continuing need remains in the art to develop methods and systems that more robustly compensate for inoperative inkjets in inkjet printers.

SUMMARY

An inkjet printer has been developed that selects a particular corrective operation for an inoperative inkjet based on one or more print metrics. The printer includes an image processor configured to identify at least one pixel in image data that corresponds to an inoperative inkjet in a printhead, to identify at least one metric for a portion of the image data that corresponds to one or more inkjets positioned to compensate for the inoperative inkjet, to select a corrective operation from a plurality of corrective operations in response to the at least one metric being greater than a predetermined threshold, and to apply the selected corrective operation to the image data, and a controller configured to generate firing signals to operate the one or more inkjets positioned to compensate for the inoperative inkjet with reference to the image data to which the image processor has applied the selected corrective operation.

A method for image correction selects a particular corrective operation for an inoperative inkjet based on one or more print metrics. The method for operating an inkjet printer includes identifying at least one pixel in image data that corresponds to an inoperative inkjet in a printhead, identifying at least one metric for a portion of the image data that corresponds to one or more inkjets positioned to compensate for the inoperative inkjet, selecting a corrective operation from a plurality of corrective operations in response to the at least one metric being greater than a predetermined threshold, applying the selected corrective operation to the image data, and generating firing signals to operate the one or more inkjets positioned to compensate for the inoperative inkjet with reference to the image data to which the selected corrective operation has been applied.

Another method for image correction selects a particular corrective operation for an inoperative inkjet based on one or more print metrics. The method for operating an inkjet printer includes identifying at least one black pixel in image data that corresponds to an inoperative inkjet in a printhead, identifying at least one metric for a portion of the image data that corresponds to two or more inkjets positioned to compensate for the inoperative inkjet, generating a cyan pixel and a magenta pixel that are positioned to produce a composite ink drop in response to the at least one metric being greater than a predetermined threshold, storing the cyan pixel and the magenta pixel to a memory in which the image data are stored, and generating firing signals to operate an inkjet ejecting cyan ink and an inkjet ejecting magenta ink to produce the composite ink drop at a location on the image receiving member corresponding to a position for an ink drop corresponding to the at least one identified black pixel.

BRIEF DESCRIPTION OF THE DRAWINGS

The foregoing aspects and other features of an inkjet printer are explained in the following description, taken in connection with the accompanying drawings.

DETAILED DESCRIPTION

Figure 1:
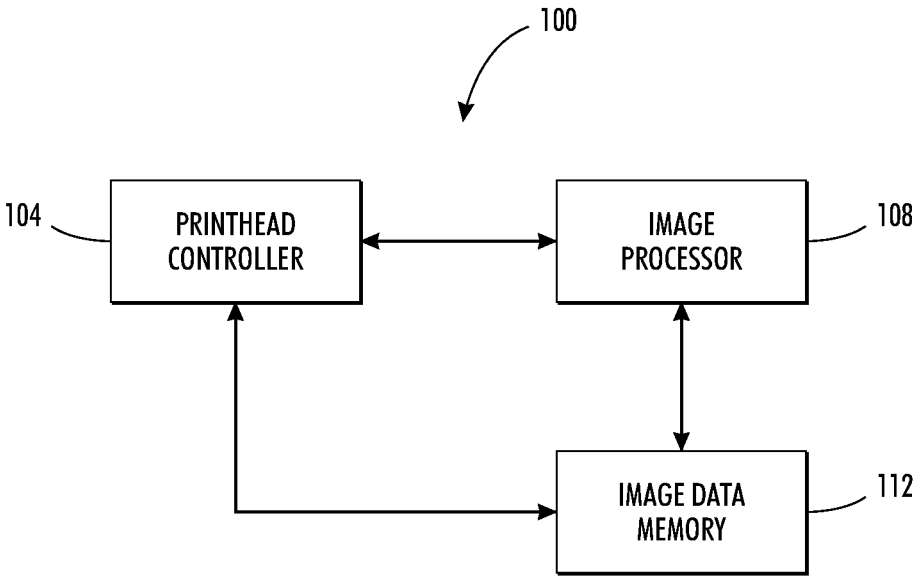
FIG. 1 illustrates a block diagram of a system that compensates for inoperative inkjets in the printheads of an inkjet printer.

For a general understanding of the environment for the system and method disclosed herein and the details for the system and method, reference is made to the drawings. In the drawings, like reference numerals have been used throughout to designate like elements. As used herein, the words "printer" and "imaging apparatus" encompasses any apparatus that performs a print outputting function for any purpose, such as a digital copier, bookmaking machine, facsimile machine, a multi-function machine, etc. Furthermore, a printer is an apparatus that forms images with marking material on media and fixes and/or cures the images before the media exits the printer for collection or further printing by another printer. The term "inoperative inkjet" refers to an inkjet that is nonfunctional, intermittently functional, that ejects too little ink in response to receiving a firing signal (i.e. a "weak" inkjet), or that is otherwise unable to eject ink. The term "operable inkjet" refers to an inkjet, which ejects a desired amount of ink in response to receiving an electrical firing signal. The terms "calculate" and "identify" include the operation of a circuit comprised of hardware, software, or a combination of hardware and software that reaches a result based on one or more measurements of physical relationships with accuracy or precision suitable for a practical application.

Figure 3:
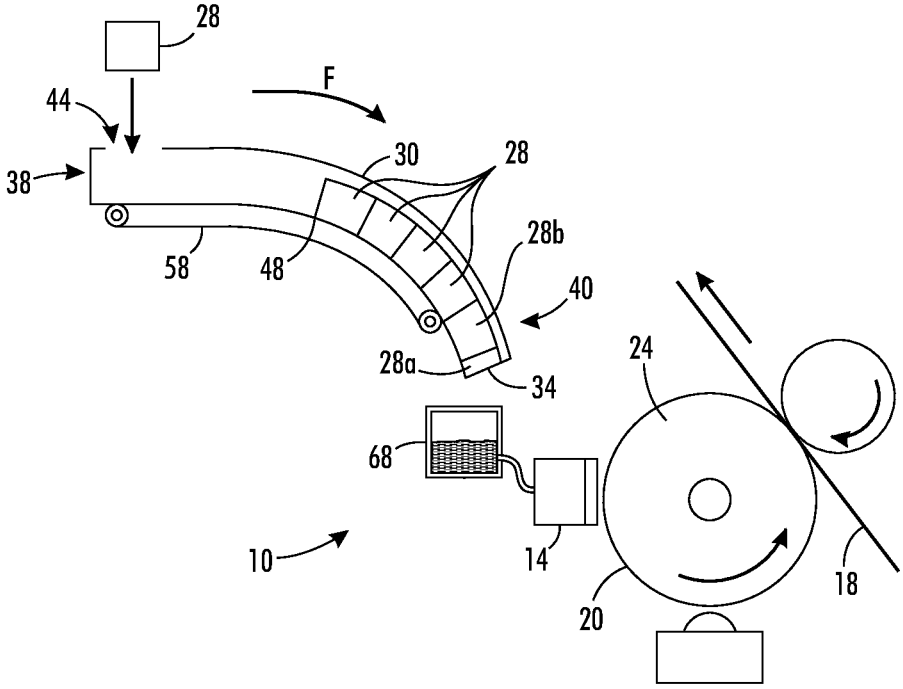
FIG. 3 PRIOR ART
FIG. 3 illustrates a block diagram of a prior art inkjet printer in which the system and the method described herein may be implemented.

As depicted in FIG. 3, a phase change ink imaging device 10 includes one or more printheads 14 having inkjets configured to eject drops of liquid phase change ink to form images on the recording media 18 using either a direct (not illustrated) or an indirect printing process (shown in FIG. 3). In a direct printing process, the drops of ink are deposited directly onto the recording media 18 by the inkjets. In an indirect printing process, the drops of ink may be deposited onto a receiving surface 20, such as an intermediate surface, typically, comprising a layer or film of release agent applied to a moving member 24, such as a rotating drum or transport belt or band. The ink is transferred from the receiving surface 20 to the recording media 18 by bringing the recording media into contact with the receiving surface 20 (and the ink thereon), as depicted in FIG. 3. The release agent facilitates the transfer of the ink to the recording media 18 while substantially preventing the ink from adhering to the rotating member 24.

Some phase change ink imaging devices, such as the device 10 of FIG. 3, are configured to receive phase change ink in its solid form as blocks of ink 28, referred to as solid ink sticks. These devices, referred to herein as solid ink printers, typically have feed channels 30 for receiving solid ink sticks 28 and feeding the solid ink sticks toward a melting assembly 34 incorporated into the printer. A feed channel 30 comprises a longitudinal chute or similar type of structure having an insertion area 38 at or near one end of the channel 30 and a melt area 40 at or near the other end of the channel 30. An insertion opening 44 in the insertion area 38 enables ink sticks 28 to be sequentially loaded into the channel 30. Once inserted, the ink sticks 28 are aligned and abutted against each other in a feed path portion 48 of the channel 30 to form a substantially continuous column of solid ink that extends between the insertion area 38 and the melt area 40 of the channel 30.

The column of solid ink is moved in a feed direction F toward the melt area 40 by a mechanized delivery system and/or by gravity until the ink stick 28*a* at the leading end of the column (i.e., the end closest to the melt area) impinges on a melting device 34, such as a heated plate, located in the melt area 40 of the channel. FIG. 3 depicts a mechanized delivery system in the form of a conveyor belt 58 driven by pulleys for delivering ink sticks 28 to the melt area 40 of the channel. In other embodiments, the delivery system may comprise a spring loaded push block configured to push, or urge, ink sticks 28 toward the melt area 40 of the channel 30.

The heated plate 34 heats the impinging portion of the ink stick 28*a* to a melting temperature for the ink which melts the solid ink to a liquid ink suitable for fluid ink transport or jetting by the inkjets of the printhead(s) 14. The melted ink is directed from the heated plate to a melted ink receptacle 68, sometimes referred to as a melt reservoir, configured to maintain a quantity of the melted ink in molten form for delivery to the inkjets of the printhead as needed. As the heated plate 34 melts the ink stick 28*a* impinging on the plate, the column of ink 50 continues to be urged toward the heated plate 34 so that the next ink stick 28*b* of the column is moved into impinging contact with the heated plate 34 when the first ink stick 28*a* has been completely melted. The reservoir 68 may be part of an intermediate ink delivery system supplying ink to the printhead(s) 14 or be integrated with the printhead (not depicted).

Figure 4:
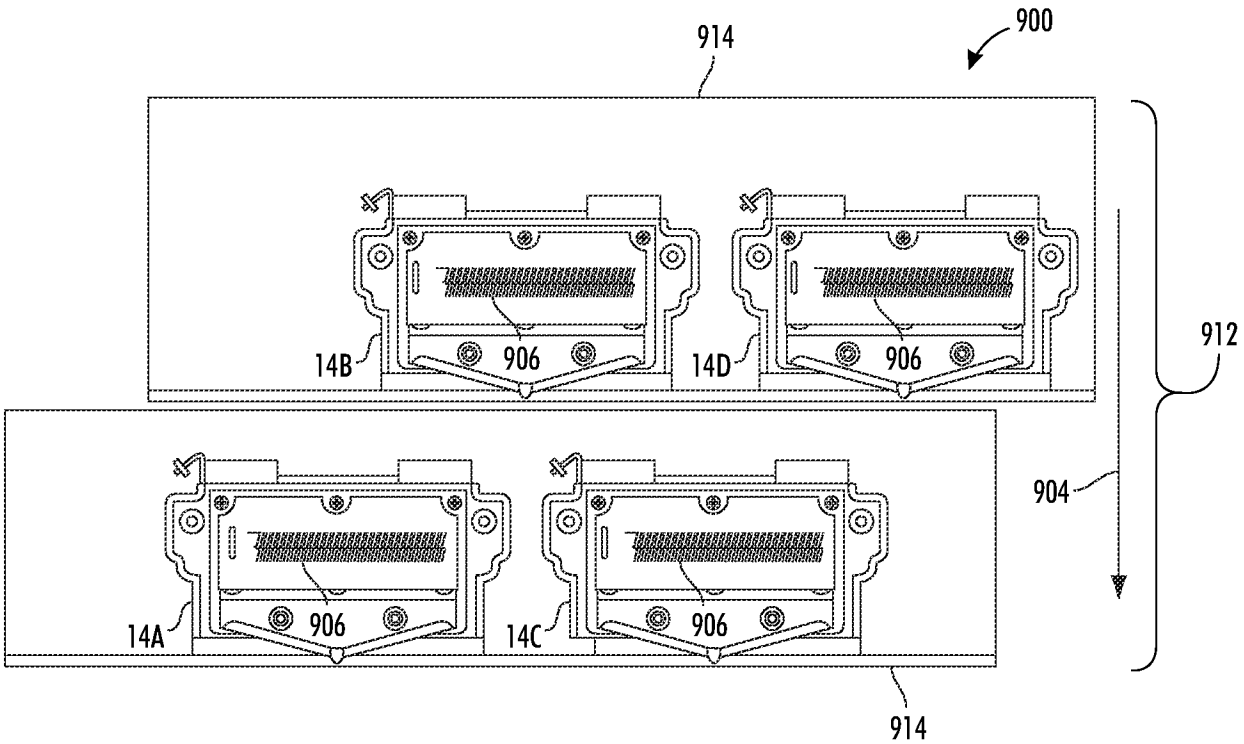
FIG. 4 PRIOR ART
FIG. 4 illustrates a block diagram of a printhead configuration of the prior art inkjet printer of FIG. 3.

A schematic view of a prior art print zone 900 that may be used in the imaging device 10 is depicted in FIG. 4. The illustrated print zone 900 includes a printhead array 912, having two print carriages 914. Each of the print carriages 914 includes one or more printheads, as exemplified by the printheads 14A, 14B, 14C, 14D. The printheads 14A and 14C are staggered with respect to the printheads 14B and 14D to provide printing across the image receiving member in the cross process direction. Additionally or alternatively, a printhead array 912 may include one or more full-width printheads (not shown), which extend continuously across the image receiving member in the cross process direction. The print zone 900 enables the inkjets in the printhead(s) of a first printhead array to be interlaced with the inkjets in the printhead(s) of a second printhead array to enable printing at an increased print resolution as measured in the cross process direction. The interlaced inkjets enable side-by-side ink drops of different colors to extend the color gamut and hues available with the printer.

The print zone 900 may include one or more printhead arrays 912 for each color of ink to be ejected onto the image receiving member. The printhead arrays 912 are arranged along a process direction 904, which is the direction that an image receiving member moves as the image receiving member travels past the printhead array(s). For example, in a CMYK printer, the print zone 900 may include one printhead array 912 for each of the ink colors cyan, magenta, and yellow and one or more printhead arrays 912 for the ink color black, since black ink is typically the most frequently ejected ink color.

As shown in FIG. 1, a system 100 is configured to process image data to compensate more robustly for one or more inoperative inkjets in the printhead(s) of an inkjet printer, such as the printer of FIG. 3. The improved system 100 analyzes not only the image data associated with the inoperative inkjets but also the image data associated with the operable inkjets that are configured to eject ink near the inoperative inkjets and various pixel substitution or corrective operations. After analyzing the image data, the system 100 selects a corrective operation from a group of available corrective operations to compensate for each inoperative inkjet. That is, the corrective operations selected for different inkjets need not be the same. For example, the system 100 may compensate for two inoperative inkjets by selecting a first corrective operation to compensate for the first inoperative inkjet and a second corrective operation to compensate for the second inoperative inkjet. Each corrective operation may be selected to maximize a different printing characteristic, such as image quality, print speed, or the like. Consequently, the system 100 identifies measurements for and evaluates various printing criteria, referred to herein as "metrics," to enable robust compensation for inoperative inkjets and to maintain image quality even though one or more inkjets are inoperative.

With continued reference to FIG. 1, the system 100 includes an image data memory 112, which is operatively connected to a printhead controller 104 and an image processor 108. The image data memory 112 is an electronic memory unit, which is configured to be read from, written to, and altered by the image processor 108 and the printhead controller 104. Additionally, the image data memory 112 is configured to receive and to store raw image data from a raw image data source. The raw image data represents an image to be printed by the printer with which the system 100 is associated. The raw image data includes a plurality of pixels, each of which may be associated with a particular ink color. For example in a CMYK printer, the image data may include a plurality of cyan pixels, magenta pixels, yellow pixels, and/or a black pixels. As described below, some pixels of the image data correspond to operative inkjets and other pixels of the image data may correspond to inoperative inkjets. A hardware device or a software application may generate the raw image data. For example, the raw image data may be generated by an electronic image scanner or a word processing software application, among other hardware devices and software applications.

The printhead controller 104 and the image processor 108 may be implemented with one or more general or specialized programmable processors that execute programmed instructions. The instructions and data required to perform the programmed functions may be stored in an electronic memory associated with the processors. The components of the printhead controller 104 and/or the image processor 108 may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits may be implemented with a combination of processors, ASICs, discrete components, or VLSI circuits. The printhead controller 104 generates firing signals from the image data as modified by the image processor 108.

The image processor 108 is configured to process the image data stored by the image data memory 112 and to modify the image data to compensate for one or more inoperative inkjets. The image processor 108 processes the raw image data to form rendered image data before compensating for the inoperative inkjets. The rendered image data includes pixels, each of which are associated with a particular inkjet of the printheads. The image processor 108 may arrange the pixels of the rendered image data by the image color content. That is, the image processor 108 groups the pixels of the rendered image data by the ink color configured to be ejected by the inkjet associated with each pixel. The portion of the rendered image data associated with a particular ink color is referred to as a color separation. For example, for a CMYK printer, the image processor 108 logically arranges the rendered image data into a cyan color separation, a magenta color separation, a yellow color separation, and a black color separation. Grouping the rendered image data by color content is useful because some metrics and corrective operations are applicable to only a particular color of ink. In particular, certain of the corrective operations described below compensate most robustly for inoperative inkjets that are configured to eject black ink.

The image processor 108 determines which pixels of the rendered image data are associated with or correspond an inoperative inkjet. A pixel that is associated with an inoperative inkjet is referred to as a "defective pixel" in this document. The pixel, however, is not defective; but rather, the inkjet associated with the pixel is defective/inoperative. The image processor 108 processes the rendered image data to identify each defective pixel. If the image processor 108 does not identify any defective pixels, the image processor may send an electronic signal to the printhead controller 104 to instruct the printhead controller to begin generating firing signals from the rendered image data. If, however, the image processor 108 identifies one or more defective pixels, the image processor analyzes and alters the rendered image data to compensate for the inoperative inkjet(s).

The image processor 108 applies at least one metric to a portion of the rendered image data in response to the identification of one or more defective pixels. The image processor 108 evaluates the metrics to determine which of the corrective operations compensates most robustly for the inoperative inkjet associated with a particular defective pixel. Specifically, the image processor 108 may apply a metric to the portion of the image data associated with the inkjets that neighbor an inoperative inkjet. The inkjets that "neighbor" an inoperative inkjet eject the same ink color as the inoperative inkjet. The neighboring inkjets may be positioned in the same printhead or a different printhead as the printhead in which the inoperative inkjet is positioned. Additionally, the neighboring inkjets may be positioned to compensate for the inoperative inkjet. The pixels of rendered image data associated with the neighboring inkjets are referred to as the "neighboring pixels." Accordingly, when processing the neighboring pixels, the image processor 108 determines a metric for the defective pixel by processing image data within the same color separation as the defective pixel.

The image processor 108 may additionally or alternatively apply a metric to the image data associated with the inkjets positioned to eject ink near the inoperative inkjet, but that are configured to eject a different color or composition of ink than the inoperative inkjet. As used herein, the inkjets positioned to eject ink near the inoperative inkjet, but that are configured to eject a different color or composition of ink than the inoperative inkjet are referred to as "complementary inkjets." The pixels of rendered image data associated with the complementary inkjets are referred to as "complementary pixels." The group of complementary pixels may include pixels positioned on more than one printhead. Additionally, when processing the data associated with the complementary pixels, the image processor 108 determines a metric for the defective pixel by processing image data in a color separation different from the color separation of the defective pixel. In general, the neighboring pixels are excluded from the group of complementary pixels.

Exemplary metrics, which may be evaluated by the image processor 108 for neighboring pixels or complementary pixels, include image resolution, ink color(s), ink composition, dither level, ink drop mass, image density, and the like. These metrics are described in more detail below. The image processor 108 evaluates the metrics to select a corrective operation intelligently. The selected corrected operation is the one that results in the highest image quality, print speed, and/or other printing criteria.

Figure 2:
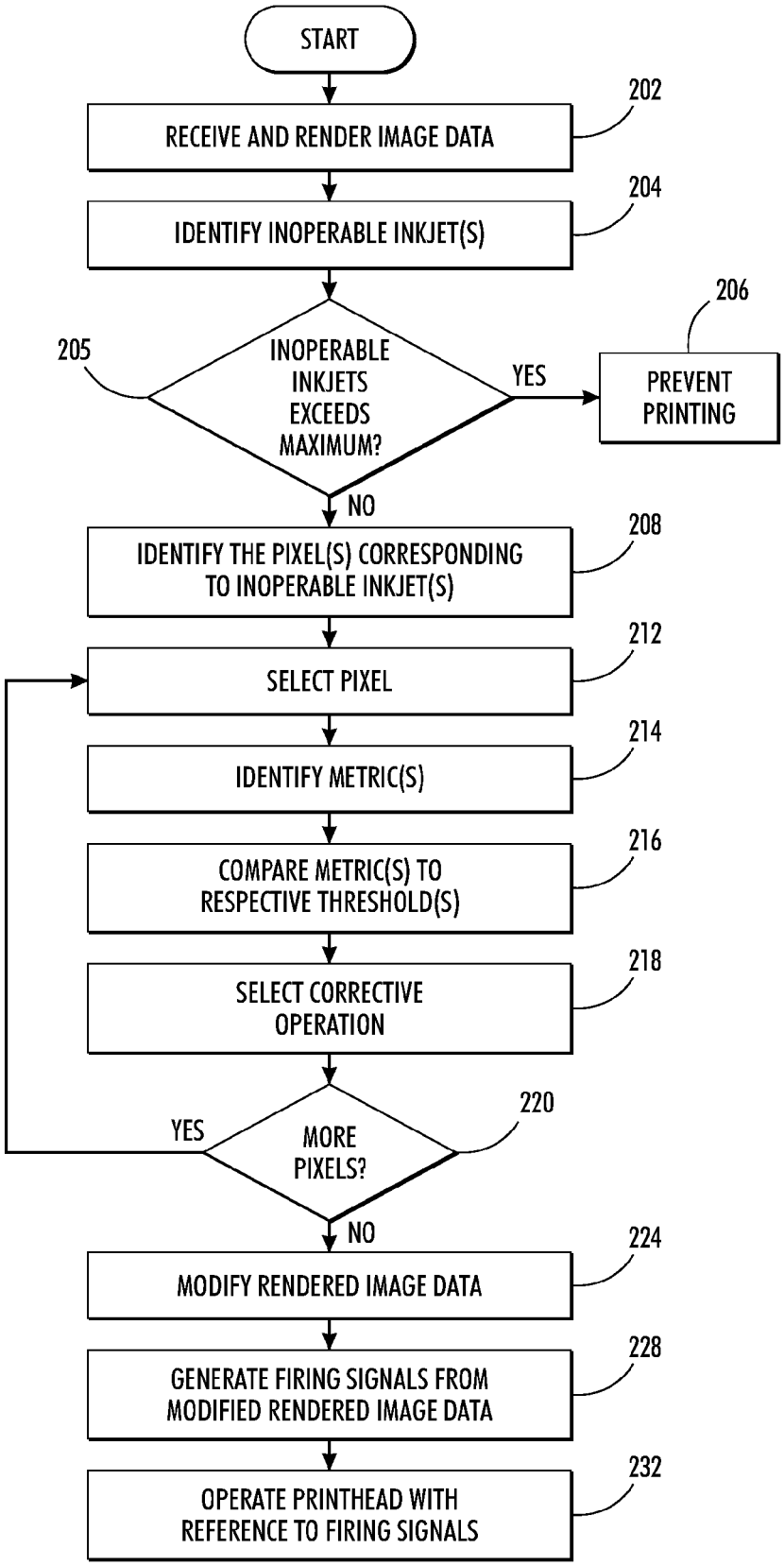
FIG. 2 illustrates a flowchart showing a method of operating the system of FIG. 1.

A printer having the system 100 may implement the method 200 illustrated by the flowchart of FIG. 2. To implement the method 200, the system 100 receives and renders image data associated with an image to be printed by the printer (block 202). Next, the system 100 identifies the inoperable inkjets in the printhead(s) of the printer (block 204). If the number of identified inoperable inkjets is above a maximum number of inoperable inkjets (block 205) the system 100 prevents the printer from printing the image (block 206). Otherwise, the number of identified inoperable inkjets is below the maximum number of inoperable inkjets and the system 100 identifies the pixels of the rendered image data that correspond to the inoperable inkjets (block 208). These pixels are "defective pixels." To compensate for the identified inoperative inkjets, the image processor 108 selects a defective pixel (block 212) and identifies one or more print metrics for the defective pixel (block 214). Then, the system 100 compares the identified metric(s) associated with a defective pixel to a corresponding metric threshold(s) (block 216). The result(s) of the comparison(s) enable the image processor 108 to identify one or more corrective operations that are suitable to compensate for the defective pixel and its associated inoperative inkjet. The image processor 108 selects one of the corrective operations from the identified corrective operations that best achieves a particular printing characteristic, such as image quality, print speed, color accuracy, and the like (block 218). This process (blocks 212-218) continues for each defective pixel until no other pixels require processing (block 220). Then the image processor 108 modifies the rendered image data according to the corrective operations selected for the defective pixels (block 224). Thereafter, the printhead controller 104 generates firing signals from the modified rendered image data (block 228) and operates the printheads of the printer according to the firing signals (block 232). Below, portions of the method 200 implemented by the system 100 are explained in greater detail.

The system 100 may accomplish manual identification of the inoperative inkjets in response to a user programming the image data memory 112 to have an electronic map, listing, or the like of each inoperative inkjet. Additionally or alternatively, the system 100 may automatically identify the inoperative inkjets with an optical recognition system (not illustrated). The optical recognition system identifies the inoperative inkjets by electronically scanning a printed image and comparing the digital image data to the image data used to print the image to determine the location of the inoperative inkjets.

If the image processor 108 identifies more than a predetermined number of inoperative inkjets (block 205), instead of preventing the printer from printing the image (block 206), the system may cause the printer to alert the operator of the printer of the excessive number of inoperative inkjets, via a user interface or the like. The operator of the printer may then choose to print the image or to cancel the printing operation, among other options.

Identification of a metric (block 214) refers to a metric measurement being made for pixels in an area and a comparison of the measurement to a threshold. The relationship of the metric measurement to the threshold enables image processor 108 to identify whether a corrective action corresponding to the metric is capable of compensating for the defective pixel. The relationship may be less than, less than or equal to, greater than, or greater than or equal to, as appropriate for each metric. The area in which the measurement is identified may include the defective pixel, the neighboring pixels, and/or the complementary pixels. The difference between a measurement and a threshold may be useful in identifying the effectiveness of a corrective operation, although other criteria may be used.

One of the metrics measured is dither level, which refers to a predetermined percentage of the total number and placement of ink drops for one ink color that may be ejected within a specified area of the printed image. The specified area is highly dithered (low predetermined percentage) when the ink drops are less numerous per unit area, and the specified area is less dithered (high predetermined percentage) when the ink drops are more numerous per unit area. When processing the dither level metric, the image processor 108 begins by identifying a desired dither level of a specified area. The portion of the specified area formed by defective pixels is referred to as an area of coverage. Next, the image processor 108 identifies a dither level corresponding to elimination of the defective pixels and the minimum dither level for the specified area. For example, a specified area may have a desired dither level of 85%. Accounting for the area of coverage to be formed by an inoperative inkjet identifies a dither level of 83%. A minimum dither level may be determined for the specified area by subtracting an error percentage from the desired dither level. In this example, the image processor 108 may use an error percentage of 5% so the minimum dither level or threshold becomes 80%. Because the dither level of 83% corresponding to the elimination of the defective pixels is greater than the dither level threshold of 80%, elimination of the defective pixels in the specified area is an acceptable corrective operation.

Another metric that the image processor 10 may use is an image density metric. The image density metric refers to the total number of ink drops per unit area of an image. The image density may be identified with reference to a portion of the image or the entire image. The image density may also refer to an average number of ink drops per unit area for a plurality of areas. Comparing an image density or average image density to a threshold image density may enable an appropriate corrective operation to be selected.

The ink drop mass metric refers to the mass of an ink drop to be ejected by an inkjet. The image processor 108 is configured to identify an ink drop mass associated with a defective pixel, a neighboring pixel, and/or a complementary pixel of the rendered image data. The image processor 108 identifies one or more corrective operations by comparing an identified ink drop mass to a threshold ink drop mass. For example, the image processor 108 may be configured to adjust the ink drop mass of a neighboring and/or complementary pixel in response to the identified ink drop mass of the defective pixel being greater than an ink drop mass threshold.

The image resolution metric refers to a number of ink drops per unit length of a line of ink drops in a printed image. For example, a printed image may have a resolution of three hundred ink drops per inch, or as more commonly denoted, three hundred dots per inch (dpi). The image processor 108 may measure the image resolution in the process direction and the cross process direction. The image processor 108 measures the process direction image resolution in the direction that the image receiving surface travels through the printer. The image processor 108 measures the cross process direction image resolution perpendicularly to the direction the image receiving surface travels through the printer. A printhead has a maximum cross process direction image resolution. The printhead may print an image with a cross process direction image resolution that is less than the maximum cross process direction image resolution by ejecting ink drops with less than all of the inkjet ejectors. A maximum process direction image resolution is related to, among other factors, a maximum rate of ink drop ejection and the minimum linear speed of the image receiving surface. A process direction image resolution less than the maximum may be achieved by decreasing the rate of ink drop ejection and/or by increasing the linear speed of the image receiving surface. The image processor 108 may be configured to identify the resolution of a line of ink drops from the rendered image data and the resolution of the line without the ink drops to be ejected by one or more defective inkjets. The image processor 108 may compare the resolution of the line without the ink drops to be ejected by the one or more defective inkjets to an image resolution threshold. The image resolution may also be referred to as a print resolution in this document.

The image processor 108 is configured to identify and/or calculate additional metrics, such as a printer identifier, a printhead configuration identifier, and a print mode. The printer identifier may be an identifying sequence of characters, numbers, and/or symbols associated with the printer. The printer identifier may indicate to the image processor 108 the total number of printheads, the arrangement of inkjets in each printhead, and the color/composition of the ink configured to be ejected by each inkjet. The printhead configuration identifier is also an identifying sequence of characters, numbers, and/or symbols associated with the printer. The printhead configuration identifier indicates to the image processor 108 the alignment of the printheads. For example, the printhead configuration identifier may indicate to the image processor 108 that the printheads of a first print carriage are interlaced with the printheads of a second print carriage, as described above with reference to FIG. 4. The print mode may indicate to the image processor 108 that the printer has been configured in a draft print mode or in a high quality print mode. In the "draft" print mode the printer may print images with an increased print speed but with a normal image quality. In the high quality print mode the printer may print high quality images at a normal print speed.

The image processor 108 selects and applies a corrective operation after evaluating one or more of the above-described metrics for each of the defective pixels. Typically, the image processor 108 selects and applies a corrective operation to the rendered image data to alter the rendered image data associated with a defective pixel, its neighboring pixels, and/or its complementary pixels. Exemplary corrective actions, which the image processor 108 may implement, include eliminating the defective pixel and generating one or more substitute pixels.

Eliminating the defective pixel refers to modifying the rendered image data to delete or remove the data associated with the defective pixel. Thus, the printhead controller 104 does not generate a firing signal for the inkjet associated with the eliminated pixel. In addition to eliminating the defective pixel, the printhead controller 104 may eliminate one or more pixels associated with an operable inkjet(s), when elimination of the pixels associated with the operable inkjet(s) would be complementary to reducing visual detection of the eliminated defective pixel(s). The elimination of a defective pixel results in the elimination of an associated ink drop in the printed image. This corrective operation may be used in response to the modified desired dither level being above the dither level threshold. In particular, when the dither level is sufficiently high, the elimination of an ink drop is generally undetectable by a viewer of the printed image. Additionally, the image processor 108 may eliminate one or more defective pixels in response to the ink drop mass of the defective pixel being below the ink drop mass threshold. When the ink drop mass of the defective pixel is below the ink drop mass threshold, elimination of the ink drop is generally undetectable by a viewer of the printed image. The image processor 108 may also eliminate one or more defective pixels when the image resolution is below the threshold image resolution. When the image resolution is below the threshold image resolution, elimination of an ink drop is generally undetectable by a viewer of the printed image. In one particular example, in a textual area of a printed image, text within a font size range of approximately 8 to 12 point may retain an acceptable appearance in response to the system 100 eliminating the pixels associated with an inoperative inkjet. Eliminated pixels in graphic areas of a printed image are generally considered tolerable unless the graphic areas are subject to intense scrutiny. If the image processor 108 determines that the identified print metrics indicate the defective pixel(s) should not be eliminated, then the image processor may consider other corrective operations.

The image processor 108 applies the substitute pixel corrective operation by altering the rendered image data to produce/generate one or more pixels that cause one or more of the neighboring and/or complementary inkjets to eject one or more ink drops to compensate for the unavailability of the inoperative inkjet. The pixels produced in the substitute pixel corrective operation are substitute pixels and they may be pixels for the same color of ink as the defective pixel or pixels for one or more colors of ink that are not the same color as the defective pixel. Substitute pixels corresponding to the same color as the defective pixel are neighboring pixels, while pixels for colors different than the defective pixel are complementary pixels. An ink drop generated by an inkjet in response to the controller 104 processing a substitute pixel is a substitute ink drop. A single substitute pixel that is substituted for a single defective pixel is referred to as a replacement pixel in this document. The replacement pixel may be, but not necessarily be, the same color as the defective pixel. An ink drop generated by an inkjet in response to the controller 104 processing a replacement pixel is a replacement ink drop. When a plurality of substitute pixels for at least two colors of ink different than the defective pixel are produced to replace the defective pixel, the printhead controller generates firing signals that produce a composite ink drop at or near the position where the ink drop corresponding to the defective pixel would have landed. As used in this document, a "composite ink drop" refers to a collection of ink drops of different colors of ink at approximately the same position on an image receiving member that reflects light with a color that is a combination of the different colors of ink. For example, in a CMYK inkjet printer, the image processor 108 may generate pixels of two or more of cyan, magenta, and yellow colors of ink at a location that enables the printhead(s) to eject ink drops of two or more of cyan, magenta, and yellow ink onto approximately the same location on the receiving member to form a composite ink drop. In this case, the differently colored ink drops blend together to form an ink drop having a dark color, which approaches the darkness of black ink. Thus, this type of composite ink drop may be well suited as a substitute for a defective pixel that causes black ink to be ejected. The pixel(s) corresponding to a substitute ink drop are stored in the memory 112.

Because substitute pixels may be produced for a color and/or composition of ink that differs from the color and/or composition of ink associated with the defective pixel, firing signals may be generated for a printhead other than the printhead containing the inoperative inkjet. Alternatively, the image processor 108 may alter the rendered image data to cause the printhead controller 104 or another component of the printer, such as an actuator, to move a printhead in the cross process direction so the substitute pixel causes an inkjet in the moved printhead to eject a replacement ink drop in the same location where the inoperative inkjet would have ejected an ink drop. Moving the printhead results in a high quality image and only marginally affects a print throughput rate.

In the substitute pixel corrective operation, the image processor 108 may alter an existing pixel for another inkjet. The existing pixel may be a neighboring pixel or a complementary pixel. This alternation includes adjusting a data value for the existing pixel to cause the inkjet corresponding to the altered pixel to eject an ink drop that is larger or smaller than an ink drop corresponding to the pixel before alteration. For example, the rendered image data may be altered to modify a neighboring pixel so the corresponding inkjet ejects an ink drop that has a mass that is 80% of a maximum ink drop mass rather than an ink drop having a mass that is 50% of the maximum ink drop mass. This increase in the mass of an ink drop ejected by an inkjet corresponding to the altered neighboring pixel may compensate for the ink drop that would have been ejected by the inkjet corresponding to the defective pixel.

The image processor 108 may apply the substitute pixel corrective operation in conjunction with other corrective operations. For example, the image processor 108 may apply the substitute pixel corrective operation and eliminate the defective pixel. The image processor 108 may also apply the substitute pixel corrective operation in response to the modified desired dither level being below the dither level threshold. When the dither level is below the dither level threshold, one or more substitute ink drops may increase the dither level for the compensated image to a level above the dither level threshold. The image processor 108 may also apply the substitute pixel corrective operation in response to the ink drop mass of the defective pixel being above the ink drop mass threshold. In which case, the resulting substitute ink drop(s) may assist in filling an ink void that would otherwise be formed if the defective pixel were simply eliminated. The image processor 108 may apply the substitute pixel corrective operation when the image resolution is above the threshold image resolution, in which case the substitute ink drop(s) may assist in maintaining the desired level of image resolution. If image processor 108 determines that the printer should not implement the substitute pixel corrective operation, then the image processor may consider another corrective operation.

The image processor 108 may apply the substitute pixel corrective operation to compensate for a defective pixel configured to print a black ink drop. That is, a plurality of substitute pixels may be generated that result in a composite ink drop being produced at the location where the defective pixel would have caused a drop of black ink to be deposited. The composite ink drop acting as a substitute for a black ink drop, however, is not always effective. For example, substituting a composite ink drop for a black pixel in a textual character may be more effective than substituting composite ink drop for a black pixel in an area of solid ink color. A black pixel refers to a pixel having data configured to cause an associated inkjet to eject ink having a black ink color. Consequently, the image processor 108 may select another corrective operation in response to the defective pixel being positioned within a region of solid ink color, as may occur when printing graphics or the graphic area of a document. In this scenario, the image processor 108 may use an appropriate metric to distinguish text from graphics. That is, the comparison of the metric measurement to a threshold may identify an area as being text in response to the measurement being greater than the threshold or vice versa.

The image processor 108 may select and apply a corrective operation by evaluating the proximity of a first inoperative inkjet to a second inoperative inkjet. The proximity of the inkjet may cause the image processor 108 to select one corrective operation over another corrective operation. For example, if two inoperative inkjets are positioned on the same printhead and within a predetermined number of inkjets from each other, the image processor 108 may determine that both defective pixels should not be eliminated because a visible ink void in the printed image would result. Similarly, if two inoperative inkjets are positioned on the same printhead and within a predetermined number of inkjets from each other, the image processor may adjust accordingly the pixel(s) selected as a substitute pixel(s) in order to avoid generating a visible ink void in the printed image.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printer comprising:

an image processor configured to identify at least one pixel in image data that corresponds to an inoperative inkjet in a printhead, to identify at least one metric for a portion of the image data that corresponds to one or more inkjets positioned to compensate for the inoperative inkjet, to select a corrective operation from a plurality of corrective operations, which includes an elimination of pixels corrective operation comprised of eliminating the at least one pixel and another pixel corresponding to an operable inkjet and at least one other corrective operation different than the elimination of pixels corrective operation, in response to the at least one metric being greater than a predetermined threshold, and to apply the selected corrective operation to the image data; and a controller configured to generate firing signals to operate the one or more inkjets positioned to compensate for the inoperative inkjet with reference to the image data to which the image processor has applied the selected corrective operation.

2. The printer of claim 1 wherein the image processor is further configured to select the elimination of pixels corrective operation in response to a dither level for the portion of the image data that corresponds to the one or more inkjets positioned to compensate for the inoperative inkjet being greater than a predetermined threshold.

3. The printer of claim 1 wherein the image processor is further configured to identify the at least one metric by identifying an ink drop mass and an image resolution for the portion of the image data that corresponds to the one or more inkjets positioned to compensate for the inoperative inkjet.

4. The printer of claim 1 wherein the image processor is further configured to select the corrective operation from the plurality of corrective operations with reference to at least one of a printer identifier, a printhead configuration identifier, an ink drop mass, an image resolution, an image color content, an image density, and a print mode.

5. The printer of claim 1 wherein the at least one metric identifies the at least one identified pixel as being a black pixel in one of a textual area and graphic area.

6. The printer of claim 1, the at least one other corrective operation different than the elimination of pixels corrective operation in the plurality of corrective operations further comprising:

generating at least one substitute pixel for the identified at least one pixel without eliminating another pixel corresponding to an operable inkjet.

7. The printer of claim 6, the generation of at least one substitute pixel further comprising:

generating a first complementary pixel; and generating a second complementary pixel.

8. The printer of claim 7 wherein the first complementary pixel corresponds to a magenta ink color and the second complementary pixel corresponds to one of a cyan ink color and a yellow ink color.

9. The printer of claim 6, the generation of at least one substitute pixel further comprising:

generating a first complementary pixel corresponding to a magenta ink color;

generating a second complementary pixel corresponding to a cyan ink color; and generating a third complementary pixel corresponding to a yellow ink color, the first, second, and third complementary pixels being generated in response to the at least one identified pixel being a black pixel.

* * * * *